US008132977B2

(12) United States Patent
Pires et al.

(10) Patent No.: US 8,132,977 B2
(45) Date of Patent: Mar. 13, 2012

(54) REFILL CONTAINER FOR CONSUMER PRODUCTS

(75) Inventors: Leo Clifford Pires, Basking Ridge, NJ (US); Roger Hwang, Maple (CA); Rahul Bose, New Delhi (IN); Iti Seth, New Delhi (IN); Koushik Kohli, Uttar Pradesh (IN); Abhisek Basak, New Delhi (IN)

(73) Assignee: Zen Design Solutions Limited, Wanchai (HK)

( * ) Notice: Subject to any disclaimer, the term of this patent is extended or adjusted under 35 U.S.C. 154(b) by 509 days.

(21) Appl. No.: 12/357,422

(22) Filed: Jan. 22, 2009

(65) Prior Publication Data

US 2010/0183355 A1 Jul. 22, 2010

(51) Int. Cl.
*A45D 40/20* (2006.01)

(52) U.S. Cl. ..... 401/88; 401/192; 401/194

(58) Field of Classification Search ..... 401/88, 401/71, 77, 78, 192, 194
See application file for complete search history.

(56) References Cited

U.S. PATENT DOCUMENTS

| | | | | |
|---|---|---|---|---|
| 2,964,170 | A * | 12/1960 | Louis et al. | 401/78 |
| 4,505,607 | A | 3/1985 | Sugiyama | |
| 5,399,040 | A * | 3/1995 | Holloway | 401/78 |
| 6,276,853 | B1 * | 8/2001 | Breidenbach et al. | 401/34 |
| 2008/0152418 | A1 | 6/2008 | Maddy | |

OTHER PUBLICATIONS

PCT international search report and written opinion of PCT/US2010/021530 dated Mar. 23, 2010.

* cited by examiner

*Primary Examiner* — Huyen Le
(74) *Attorney, Agent, or Firm* — Patterson & Sheridan, LLP

(57) ABSTRACT

The present invention generally is a refill container for holding at least two products. The refill container of the present invention is configured to comprise at least two receptacles abutting each other, wherein either all the receptacles contain a similar product or one of the receptacles holds a related product or a tool. Each of the receptacles has a top end, a bottom end and at least one sidewall. The refill container is configured to be mounted in a refillable case wherein the refillable case comprises of a base and a cover. Also disclosed is refillable product container in which are replaced the refill containers once the initial product is finished.

11 Claims, 9 Drawing Sheets

REFILL CONTAINER FOR CONSUMER PRODUCTS

BACKGROUND

1. Field of the Invention

Embodiments of the present invention generally relate to refill containers. More particularly the invention relates to refill containers storing at least two products. The invention also relates to refill containers for holding consumer products such as cosmetic or care products. The refill container of the present invention is configured to comprise at least two receptacles abutting each other, wherein either all the receptacles contain a similar product or a related product or a tool. There is also disclosed a refill container that provides an indication of the kind and actual color of the product stored in it thereby making the merchandising easy and also making it easier for the consumer for choosing the product during storage.

2. Description of the Related Art

Refill containers for consumer products are considered environmental friendly in a way that lesser material is utilized in their manufacturing. These are also economical for the consumers as well as manufacturers. The consumers don't have to spend the same amount of money for the refills while for manufacturers they enable lower consumption of inputs such as raw materials and energy. Various attempts have been made to refine make-up packages such as compacts, lipsticks, etc. to provide an option of refilling the product. The known refill containers for cosmetic products generally comprise of a refillable case that houses the product which may or may not have a propelling/dispensing mechanism therefore and such refills are then replaced into the refillable case once the product is used by the user. For example, there are available stick product packages which are refillable where a refill cartridge is replaced once the stick is used up by the user. There are also available compact cases in which the pans are refillable. However, the refillable cases existing are such that they show the color or kind of product either through transparent covers or there are present adhesive labels at the base of the refillable case. However, when the cover and base of the refillable case are opaque there remains no option for the consumer to remember the color or kind of product replaced by him/her in the refillable case. Therefore, there exists a problem of the color or kind of product not being able to be seen once the refill is housed in the refillable case. Further, as yet there is not available any refill container which has multiple product storage. Therefore, it would be desirable if a refill container is available which shows color once it is housed in the container. Also, a refill container with multiple product storage would be more economical for the consumer. Moreover, such a refill container would prove to be more sustainable as this would be creating lesser burden on the environment.

Most of the refillable packages are available for stick consumer products. For example, U.S. Pat. No. 4,505,607 to Sugiyama discloses a retractable-type cosmetic container that includes a holder having a cosmetic projecting-retracting means and adapted to be mounted on a manipulating member provided separately from the holder, and a cap closure. An inner tube of the holder is provided at its lower end with an opening of angular shape within which a hollow projection of the manipulating member is detachably engaged for unitary rotation of the member and the inner tube. Similarly U.S. Pat. No. 5,399,040 to Holloway discloses a refill cartridge comprising a cosmetic holder including a tubular inner body, a tubular cam sleeve covering tubular inner body, and an elevator cup within inner body and a retaining means is provided to hold the refill and the base member together.

However, these packages have a limitation of not being able to show the kind or color of product to the user while on the shelf or under storage and the user therefore would open every package to choose the product or while at home would open each package before every usage to select the color/kind of product. In case of a refillable lipstick when the content of the product remaining in the package is very less then the user would also need to propel the stick rather than just open the cap to identify the product stored. These steps result in the product being exposed frequently which in turn may become a cause of contamination as well as drying out of the product.

Further, there are also problems during usage as the user would not be able to identify/remember the color of the product that has been replaced and hence the user would open the package before every usage. Conventional visual indicators of the color and kind of product in make-up sticks are often adhesive labels that can be inadvertently removed from the package. Further, other existing refillable packages do not have visual color indicators that are interchangeable, so that a user cannot retain the existing case and replace the product and the color indicator with a different color.

United States Patent Application No. US 2008/0152418 to Maddy discloses a color insert configured in a cap of container to indicate the color of the cosmetic product contained in a container. The insert is coupled to the cap and is replaceable. However, it requires manual efforts of the user to change the color insert in the cap every time the cartridge is replaced. This again is an added step which would be time-consuming for the users. Today, consumers want on-the-go products so that they don't have to do much. Moreover, if the user forgets to change the color insert of the cap then again he/she has to face the same difficulties as in conventional refillable packages.

Therefore, it is desirable that the user gets a visual indication of the kind and color of product every time he/she replaces the refill without the need for the user to carry out any additional work other than replacing the desired refill. Further, a refill container with multiple product storage would be more economical for the consumer and at the same time would prove to be more sustainable as this would be creating lesser burden on the environment.

SUMMARY

The present invention generally is a refill container for holding at least two products. The refill container of the present invention is configured to comprise at least two receptacles abutting each other, wherein either all the receptacles contain a similar product or one of the receptacles holds a related product or a tool.

According to an embodiment of the invention the refill container comprises at least two receptacles that are abutting each other. Each of the receptacles has a top end, a bottom end and at least one sidewall. The refill container is configured to be mounted in a refillable case wherein the refillable case comprises of a base and a cover. In order for the refillable case to be refilled, the base is configured to receive one of the receptacles of the refill container. Accordingly the base of the refillable case and the receptacle of the refill container to be received by said base have a suitable locking arrangement to securely keep the refill container in the base of the refillable case. For example, the base may have a faceted cavity and accordingly there may be present corresponding facets on the outer sidewall of the receptacle of the refill container which is to be received in the base.

According to an embodiment of the invention the receptacles are configured to be attached to each other by a suitable attachment means. The attachment means may be a one-time snap fit arrangement or a threaded engagement or a sonic welding or any other suitable joining means may be used. Further, the receptacles may be configured to be removably connected to each other. Alternatively the receptacles may be fixedly connected to each other.

According to another embodiment of the invention the receptacles of the refill container house a consumer product or a tool. Further, at least one receptacle may alternatively contain either a tool such as an application tool, a battery/light operated massager, or a mirror which is also accessible when the refill container is mounted on the base of the refillable case.

According to yet another embodiment of the invention at least one receptacle of the refill container may further comprise a suitable closure member for securely receiving the product or tool inside it. Further, the closure member may be a cap which is flip open or the cap may be threadedly engaged or the receptacle may swivel open from the base of the refillable case.

According to another embodiment of the invention at least one receptacle of the refill container may optionally comprise a propelling mechanism assembly or a part of a propelling mechanism assembly for driving the product wherein said propelling mechanism assembly is actuated when the refill container is mounted on the base of the refillable case. Alternatively, optionally the propelling mechanism assembly or a part of the propelling mechanism assembly may be present in the base of the refillable case for driving the product housed in the receptacle wherein the propelling mechanism assembly is actuated when the refill container is mounted on the base.

In accordance with yet another embodiment of the invention there is provided a refill container that provides an indication of the kind and actual color of the product stored in its receptacles thereby making the merchandising easy and also making it easier for the consumer for choosing the product during storage. For example, the base of the refillable case may have a cut-out window such that when a receptacle containing a product is fitted onto it, the cut-out window shows the actual color and kind of the product contained in the receptacle. Alternatively the receptacle to be received by the base of the refillable case may either be transparent or may have a transparent window to show the color and kind of the product stored in it. Further this receptacle may be placed at any such position with respect to the other receptacles that the product stored in it may be seen when the refill container is mounted on the base of the refillable case. The receptacle may therefore act as a visual indicator of the actual color and kind of the product contained.

In accordance with yet another embodiment of the invention the refill container may comprise a first receptacle and a second receptacle said receptacles having a top end, a bottom end and at least one sidewall. Further, the two receptacles are configured to be attached to each other in such a way that the bottom end of the second receptacle abuts the bottom end of the first receptacle said receptacles being configured to be connected to each other by a suitable attachment means. The attachment means may be a one-time snap fit arrangement or a threaded engagement or a sonic welding or any other suitable joining means may be used. Further, the receptacles may be configured to be removably attached to each other. Alternatively the receptacles may be fixedly attached to each other. Alternatively, the second receptacle may be configured to be an integral part of the first receptacle.

In accordance with yet another embodiment of the invention the first receptacle holds a first product for example, a stick consumer product and the second receptacle holds a second product wherein the second product is similar to the first product or is a related product or a tool. Further, there may be present optionally a propelling mechanism assembly or a part of the propelling mechanism assembly in the first receptacle of the refill container for driving the stick product wherein said propelling mechanism assembly is actuated when the refill container is mounted on the base of the refillable case. Alternatively, a propelling mechanism assembly or a part of the propelling mechanism assembly may be present in the base of the refillable case for driving the stick product housed in the first receptacle wherein the propelling mechanism assembly is actuated when the refill container is mounted on the base of the refillable case. The propelling mechanism assembly may comprise of any mechanism that is suitable for driving a stick product such as a general lipstick mechanism, a threaded screw mechanism, a sliding mechanism or any other suitable mechanism.

In accordance with yet another embodiment of the invention the propelling mechanism assembly may be a lipstick mechanism assembly. The lipstick mechanism assembly comprises of a drive, helix and a cup to dispense the product.

According to yet another embodiment of the invention the second receptacle may or may not have a closure member for securely receiving the product or tool inside it.

In accordance with yet another embodiment of the invention the second receptacle may contain a product similar to that of the product stored in the first receptacle thereby providing an indication of the kind and actual color of the product stored in the refill container and thereby making the merchandising easy and also making it easier for the consumer for choosing the product during storage. For example in a refill container for a lipstick, the lipstick product may be stored in the first receptacle and the same product may be contained in a second receptacle which attaches with the base of the refillable case and shows the color of the product stored in the first receptacle thereby providing an indication of the color of the refill replaced by the consumer.

According to yet another embodiment of the invention the base of the refillable case may have a cut-out window. Further, the second receptacle received in the base of the refillable case may contain a similar product as in the first receptacle. The second receptacle may either be transparent or may have a transparent window to show the color and kind of the product stored in it. The second receptacle when fitted onto the cavity of the base the cut-out window in it shows the actual color and kind of the product contained in the second receptacle. Alternatively, the second receptacle may be placed at any such position with respect to the first receptacle that the product stored in second receptacle may be seen when the refill container is mounted on the base of the refillable case. The receptacle may therefore act as a visual indicator of the actual color and kind of the product contained in the first receptacle. The second receptacle may alternatively contain a related product that is accessible from the base of the refillable case. The second receptacle may either be transparent or may have a transparent window to show the color and kind of the product stored in it. The second receptacle may be placed at any such position with respect to the first receptacle that the product stored in it may be accessible when the refill container is mounted on the base of the refillable case. Furthermore, the second receptacle may alternatively contain either a tool such as an application tool, a battery/light operated massager, or a mirror which is also accessible when the refill container is mounted on the base of the refillable case. Furthermore, the second receptacle may comprise a closure member such as a cap which is flip open or the cap may be threadedly engaged or the receptacle may swivel open from the base of the refillable case.

According to yet another embodiment of the invention there is provided a refillable product container in which the refill containers may be replaced once the product is finished by the user. The refillable container comprises a refillable case and a refill container wherein the refillable case comprises a cover and a base. The refill container comprises at least two receptacles as described in above embodiments of the invention. As an example the refill container to be replaced in the refillable product container may comprise a first receptacle and a second receptacle, said first receptacle may hold a first product for example a stick product and the second receptacle holds either a similar product or a related product or a tool which is configured to be accessible through the base of the refillable container. The refillable container may also comprise a propelling mechanism assembly for the stick product. The refill container may be configured to be detachably mounted on the base of the refillable case. The propelling mechanism assembly may comprise a mechanism to drive the stick product up or down. The propelling mechanism assembly may comprise of any suitable mechanism that is suitable for driving a stick product such as a general lipstick mechanism, a threaded screw mechanism, a sliding mechanism or any other suitable mechanism. The second receptacle comprises a top end and a bottom end wherein the bottom end abuts the bottom end of the first receptacle and is attached to the first receptacle by a suitable attachment means. The refill container is configured to be mounted on the base of the refillable case. The base of the refillable case may comprise a faceted cavity. The faceted cavity is one of the ways of locking the refill container with the base, however, any other suitable arrangement may be used for locking the base and the refill. The top end of the refill is facing the cover while the bottom end faces the base. The receptacles of the refill container may be configured to be removably attached to each other. Alternatively the receptacles may be fixedly attached to each other. The base of the refillable container may have a cut-out window in it. Further, the second receptacle may contain a similar product as in the first receptacle. The second receptacle may either be transparent or may have a transparent window to show the color and kind of the product stored in it. The second receptacle may therefore act as a visual indicator of the actual color and kind of the product contained in the refillable container. Alternatively, the second receptacle may be placed at any such position with respect to the first receptacle that the product stored in second receptacle may be seen when the refill container is mounted on the base of the refillable case. The receptacle may therefore act as a visual indicator of the actual color and kind of the product contained in the first receptacle. The second receptacle may alternatively contain a related product that is accessible from the base of the refillable case. The second receptacle may either be transparent or may have a transparent window to show the color and kind of the product stored in it. Further, the second receptacle may alternatively contain either a tool such as an application tool, a battery/light operated massager, or a mirror which is also accessible when the refill container is mounted on the base of the refillable case. Furthermore, the second receptacle may comprise a closure member such as a cap which is flip open or the cap may be threadedly engaged or the receptacle may swivel open from the base of the refillable case.

According to yet another embodiment of the invention the at least one of the receptacles of the refill container may contain a consumer product such as a cosmetic or a care product such as lipstick, eye shadow, lip balm, concealer, a muscle relaxant, foundation, concealer, bronzer, lip color, a balm, a solid perfume, exfoliator, shimmer, highlighter, concealer, primer, base balm or wipes or at least one of the receptacle may contain a tool such as an applicator, battery/light operated massager, or a mirror. The products contained in different receptacles may also be complementary, i.e. they may be intended for depositing simultaneously or in succession on the same treated region. Also, in case of cosmetic makeup products, the color of the products stored in different receptacles may be similar or different from each other. For example, in a refill container comprising two receptacles one of the two products may be a cosmetic or a care product, and the other product may be intended to modify the color and/or the texture of the first product in such a manner as to match its color to a skin color or to a particular makeup effect.

There is provided a refill container that has multiple product storage and is more economical for the consumer and at the same time is more sustainable.

BRIEF DESCRIPTION OF THE DRAWINGS

So that the manner in which the above recited features of the present invention can be understood in detail, a more particular description of the invention, briefly summarized above, may be had by reference to embodiments, some of which are illustrated in the appended drawings. It is to be noted, however, that the appended drawings illustrate only typical embodiments of this invention and are therefore not to be considered limiting of its scope, for the invention may admit to other equally effective embodiments.

Figure 1:
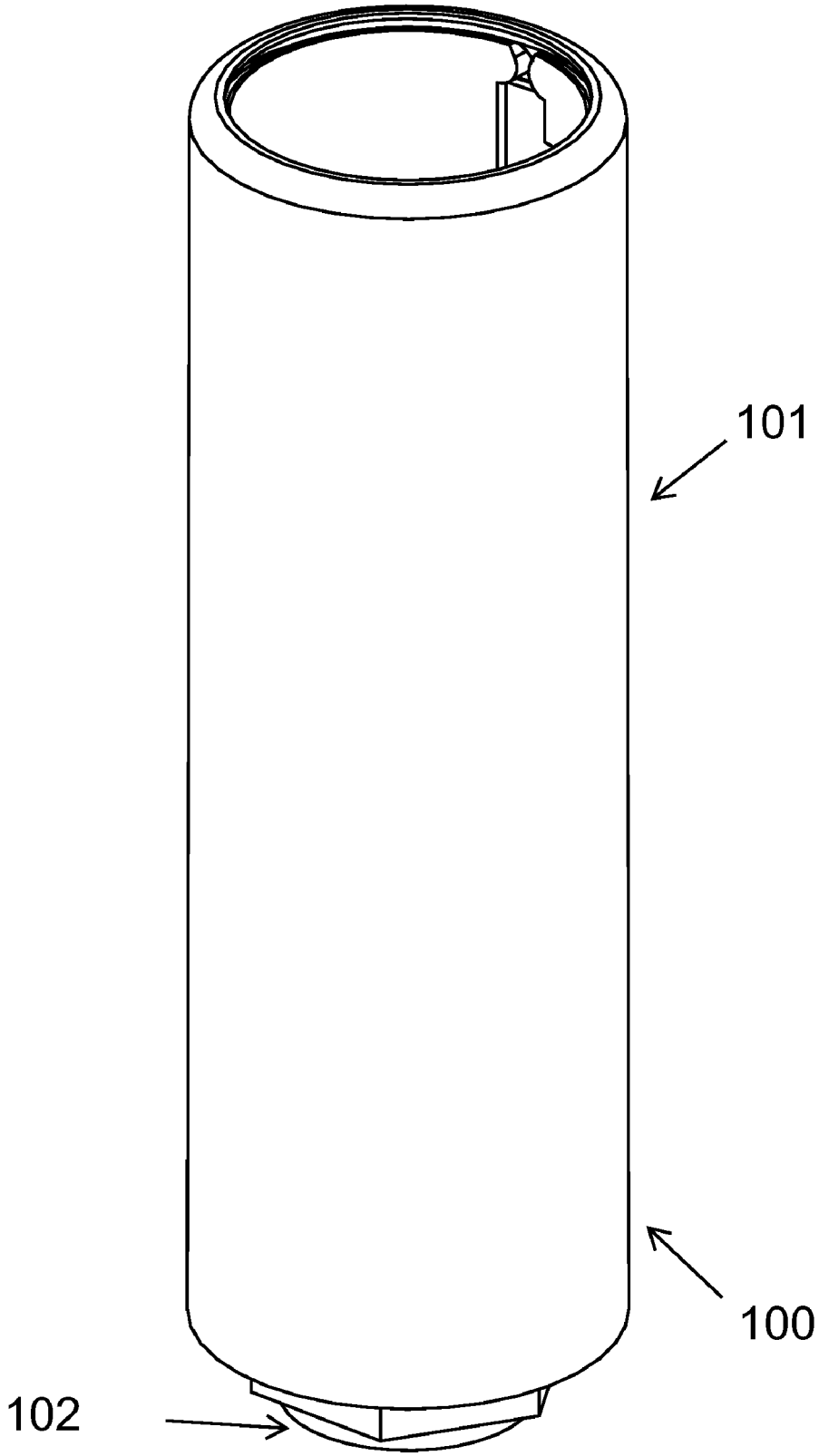
FIG. 1 is an isometric view of the refill container according to one embodiment of the invention.

To facilitate understanding, identical reference numerals have been used, where possible, to designate identical elements that are common to the figures. It is to be noted, however, that the appended drawings illustrate only typical embodiments of this invention and are therefore not to be considered limiting of its scope, for the invention may admit to other equally effective embodiments.

DETAILED DESCRIPTION

FIG. 1 is one embodiment of the present invention showing the refill container 100. As represented in FIGS. 1 through to 5, the refill container 100 comprises a first receptacle 101 and a second receptacle 102. The second receptacle 102 is configured to be attached to the first receptacle 101 by an attachment means 103. The attachment means 103 as shown in the figure is a one-time snap fit arrangement, however, the second receptacle 102 may be removably connected to the first receptacle 101 by way of a suitable attachment means such as a threaded engagement with the bottom end of the first receptacle 101 of the refill container 100. Alternatively the receptacles may be attached by way of magnetic or snap fit arrangement or any other suitable arrangement.

Figure 2:
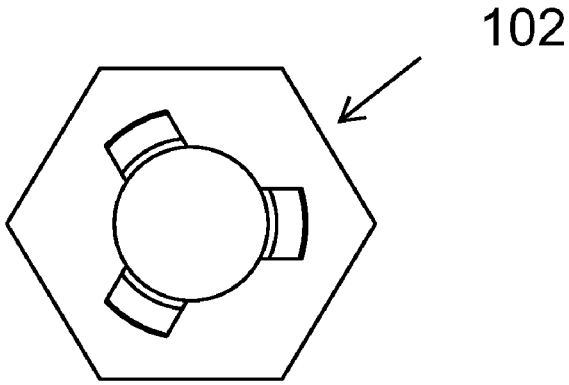
FIG. 2 is a top view of the second receptacle of the refill container of FIG. 1.
Figure 3:
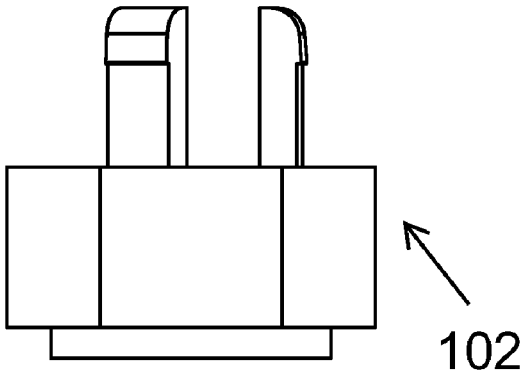
FIG. 3 is a front view of the second receptacle of the refill container of FIG. 1.
Figure 4:
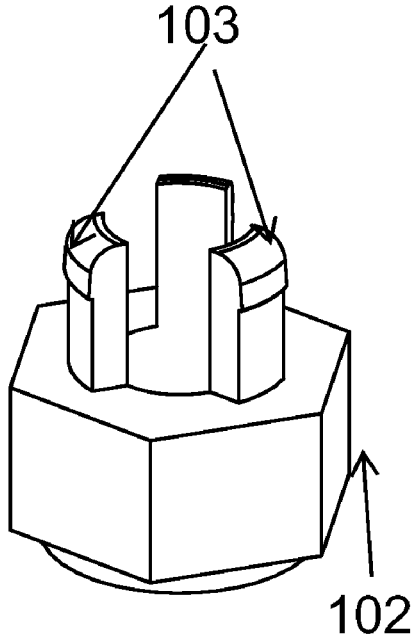
FIG. 4 is an isometric view of the second receptacle of the refill container of FIG. 1.

The second receptacle 102 as shown in FIGS. 2 to 4 is configured to be an integral part of the refill container 100. As illustrated, the first receptacle 101 and the second receptacle 102 are configured to contain a stick product and a similar or related product respectively, however, any other suitable product may also be stored, for example, the first and second receptacles 101 and 102 may be in the form a compact cosmetic case as well. The second receptacle 102 may be made to be transparent or it may have a window to allow the user to see the actual color and kind of the product contained in it. The products contained in the first receptacle 101 and the second receptacle 102 may be complementary, i.e. they may be intended for depositing simultaneously or in succession on the same region of body. The color of the product in receptacle 102 may be different from that of the stick product in the first receptacle 101. One of the products may be a cosmetic or a care product, and the other product may be intended to modify the color and/or the texture of the first product in such a manner as to match its color to a skin color or to a particular makeup effect, for example. Alternatively, the second receptacle 102 may contain either a tool such as an application tool, a battery/light operated massager, or a mirror which is also accessible/operable through the base of the refillable container.

Figure 6:
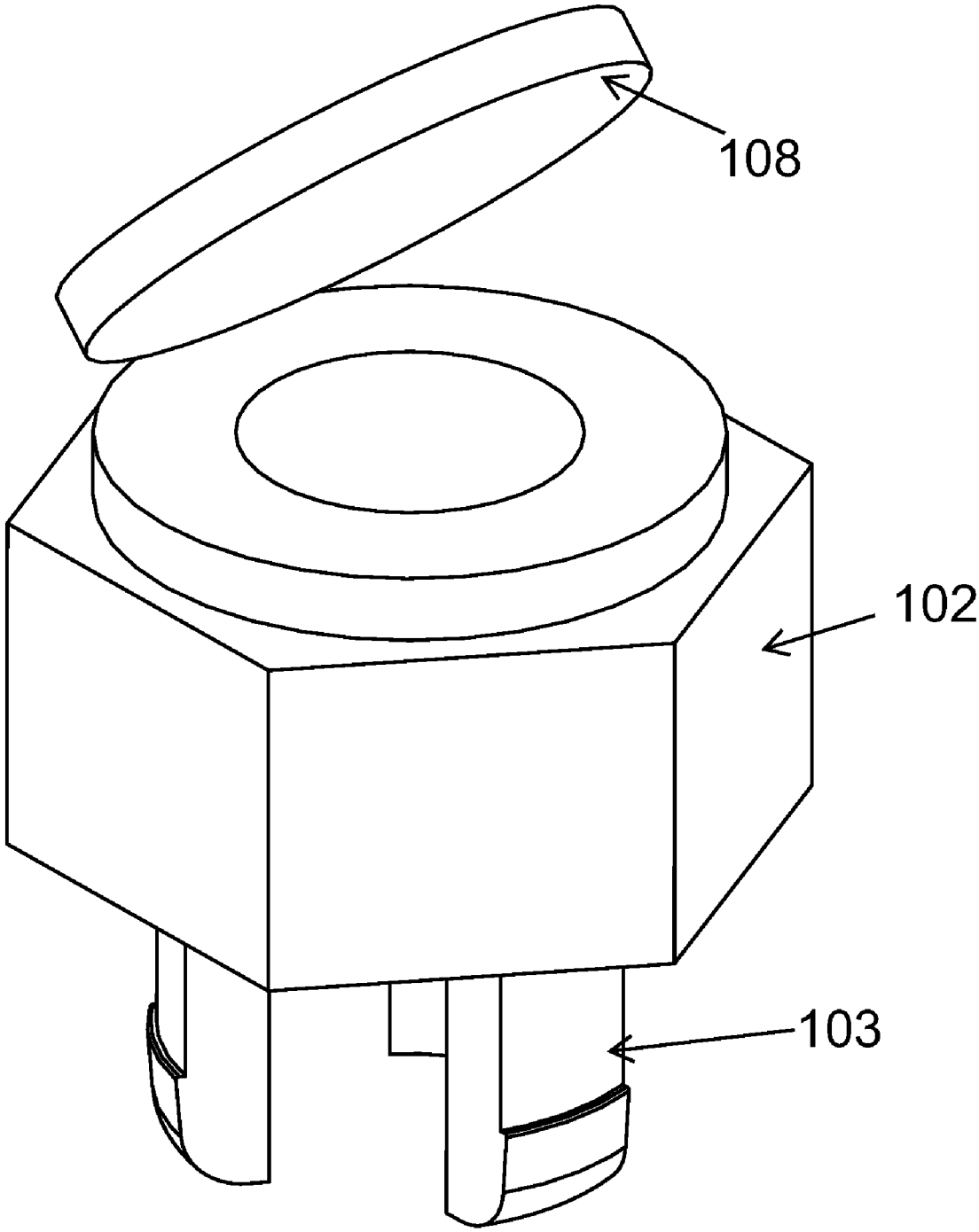
FIG. 6 is an isometric view of the second receptacle according to another embodiment of the invention.

The first receptacle 101 and the second receptacle 102 may be made of a suitable polymeric material such as acrylonitrile butyrene styrene or any other suitable material. Further, as shown in FIG. 6, the second receptacle may also comprise a suitable closure member 104 to secure the product stored in it. The closure member 104 may be a screw cap, snap cap or it could be connected by any other suitable means such as a pin hinge, an integrated PP hinge. The closure member 104 may alternatively swivel out from the base to access the product stored in the second receptacle 102.

Figure 5:
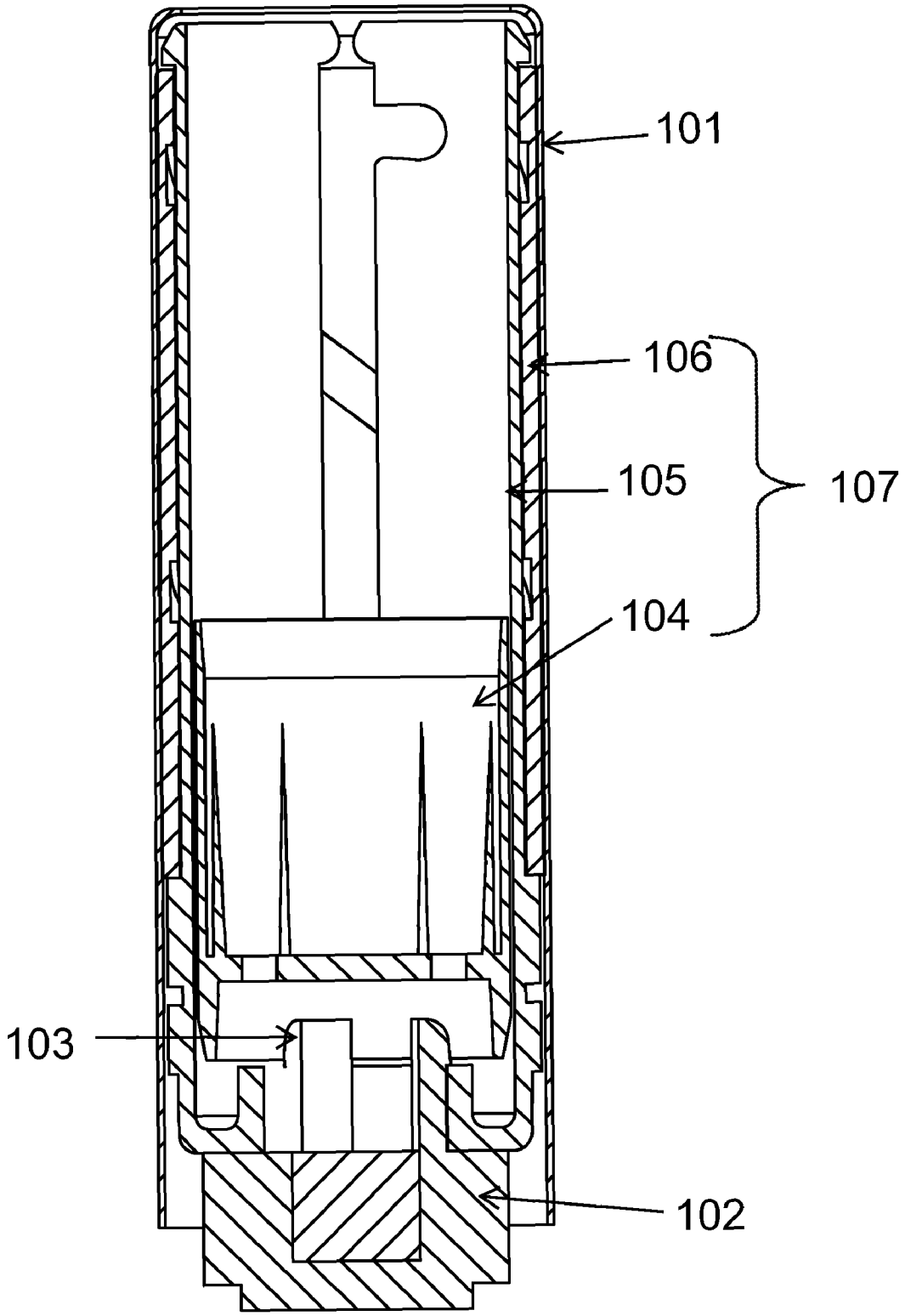
FIG. 5 is a cross-sectional view of the first receptacle of the refill container of FIG. 1.

As illustrated in FIG. 5, the first receptacle 101 houses a propelling mechanism assembly 107 for a stick product to be housed in the refill container 100. The propelling mechanism assembly 107 comprises of a cup 104, a drive 105 and a helix 106. The propelling mechanism assembly 107 may alternatively comprise of any mechanism that is suitable for driving a stick product such as a general lipstick mechanism, a threaded screw mechanism, a sliding mechanism or any other suitable mechanism.

Figure 7:
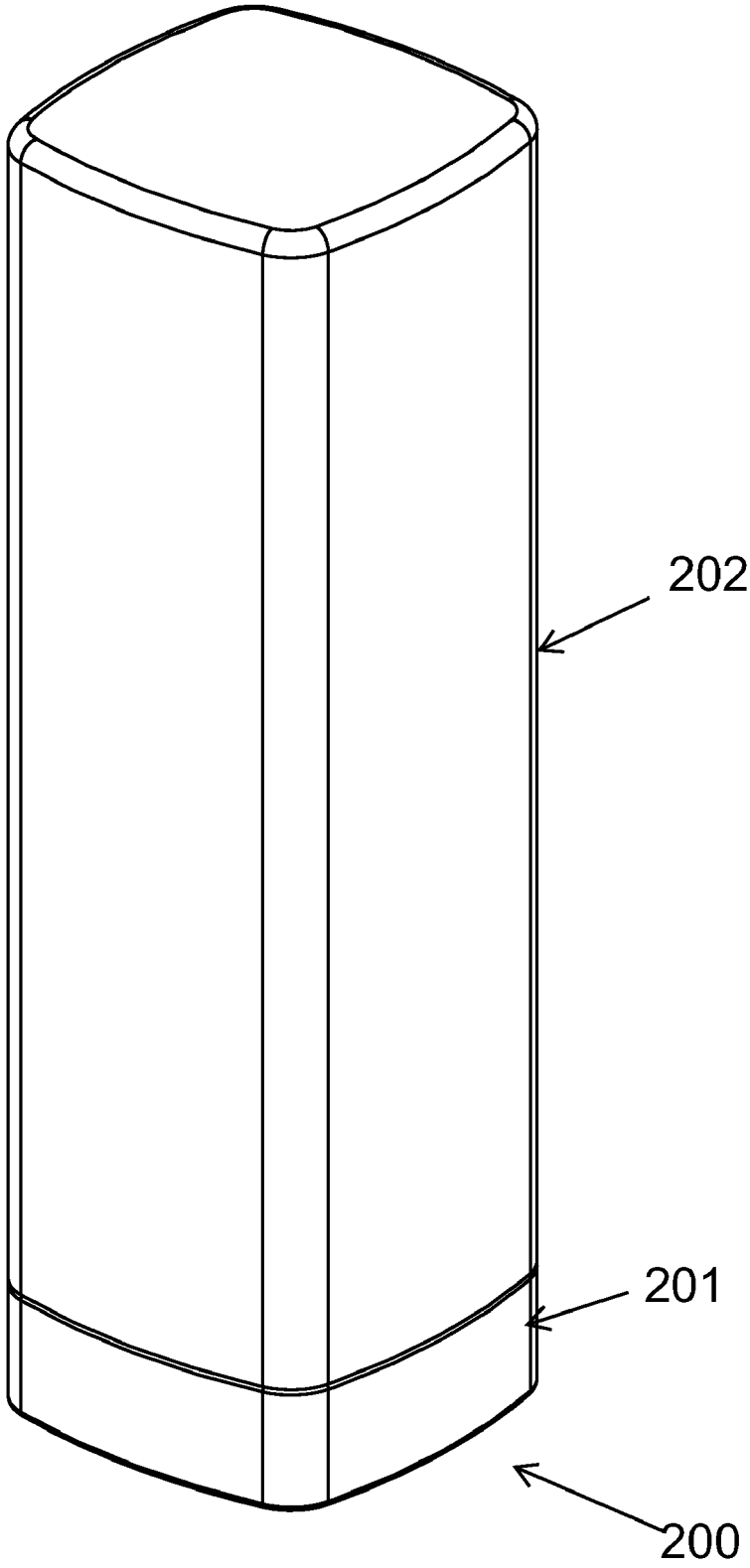
FIG. 7 is a refillable container according to an embodiment of the invention.
Figure 8:
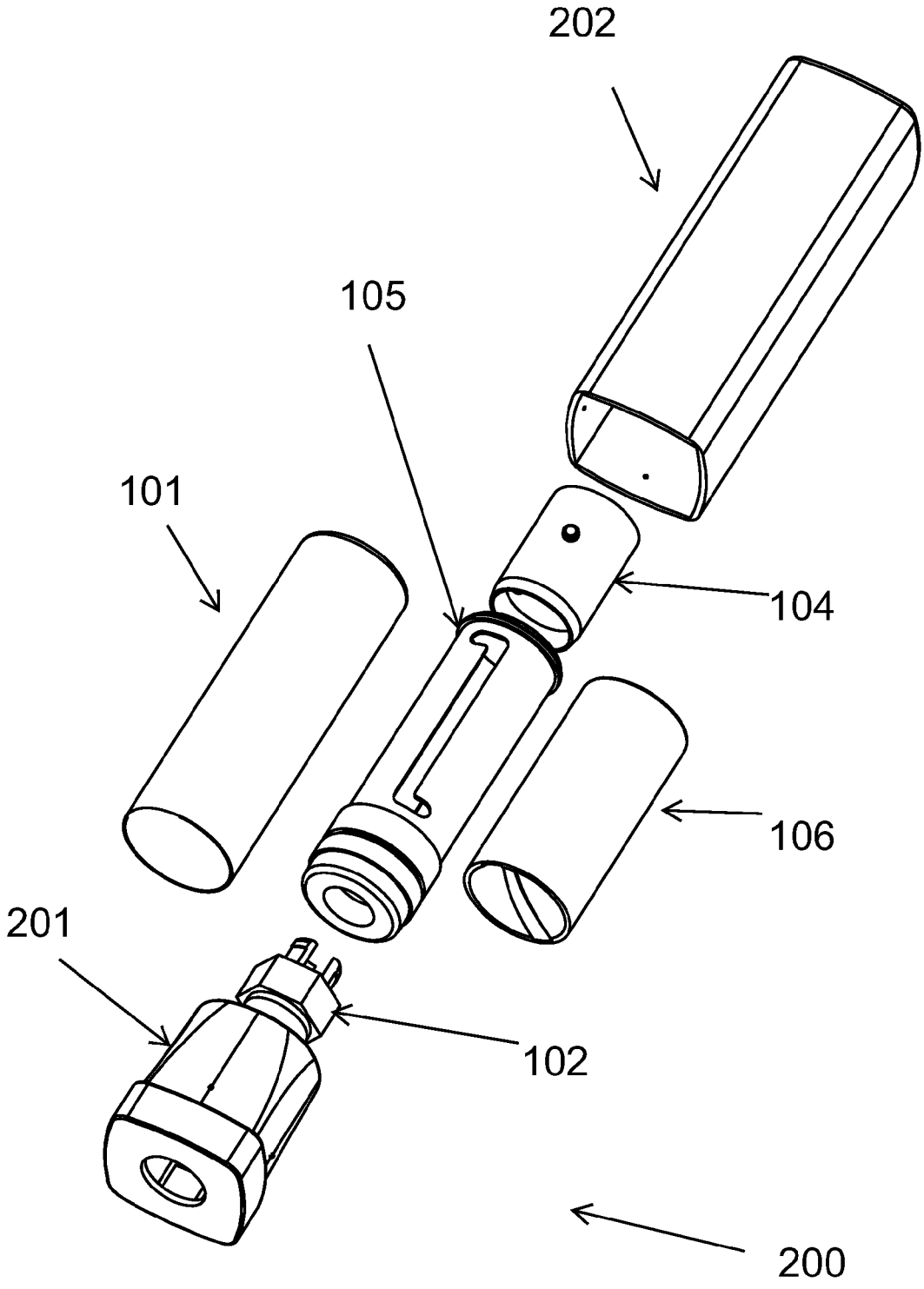
FIG. 8 is an exploded view of the refillable container of FIG. 7.
Figure 9:
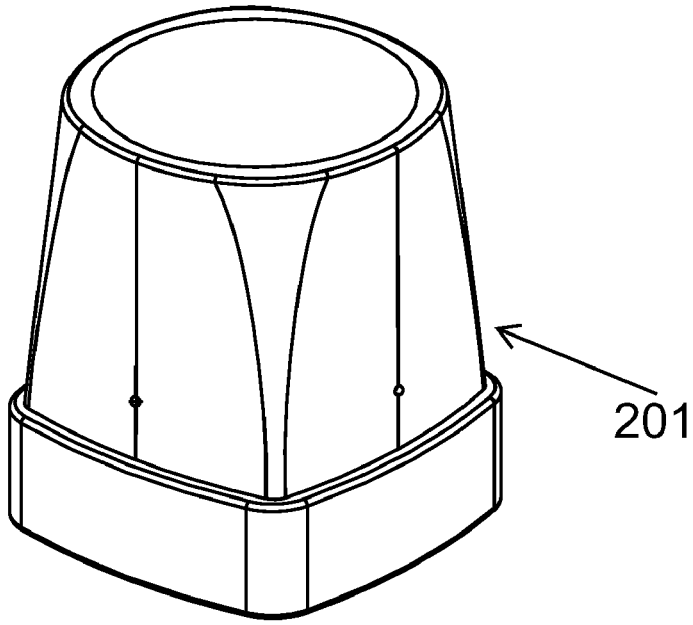
FIG. 9 is an isometric view of the base of the refillable container of FIG. 7.
Figure 10:
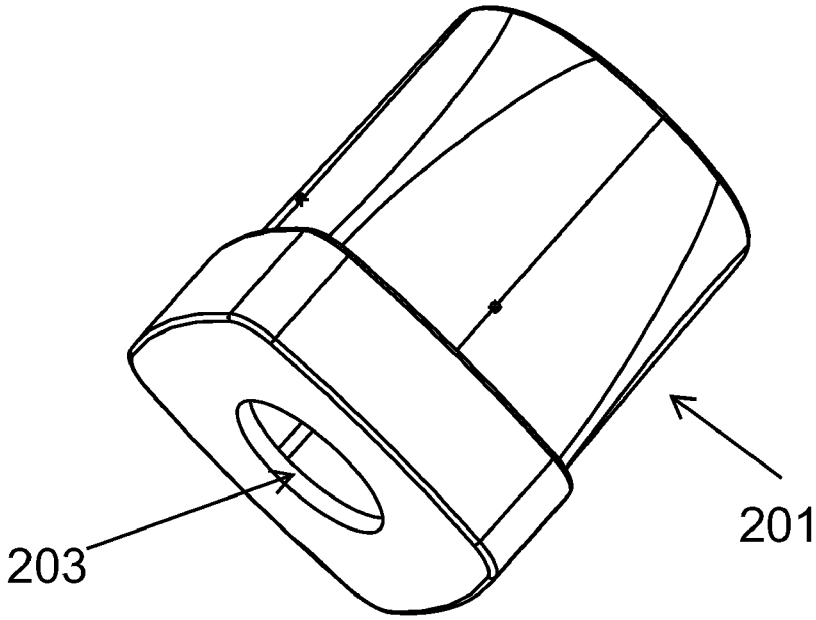
FIG. 10 is a front view of the base of the refillable container of FIG. 7.
Figure 11:
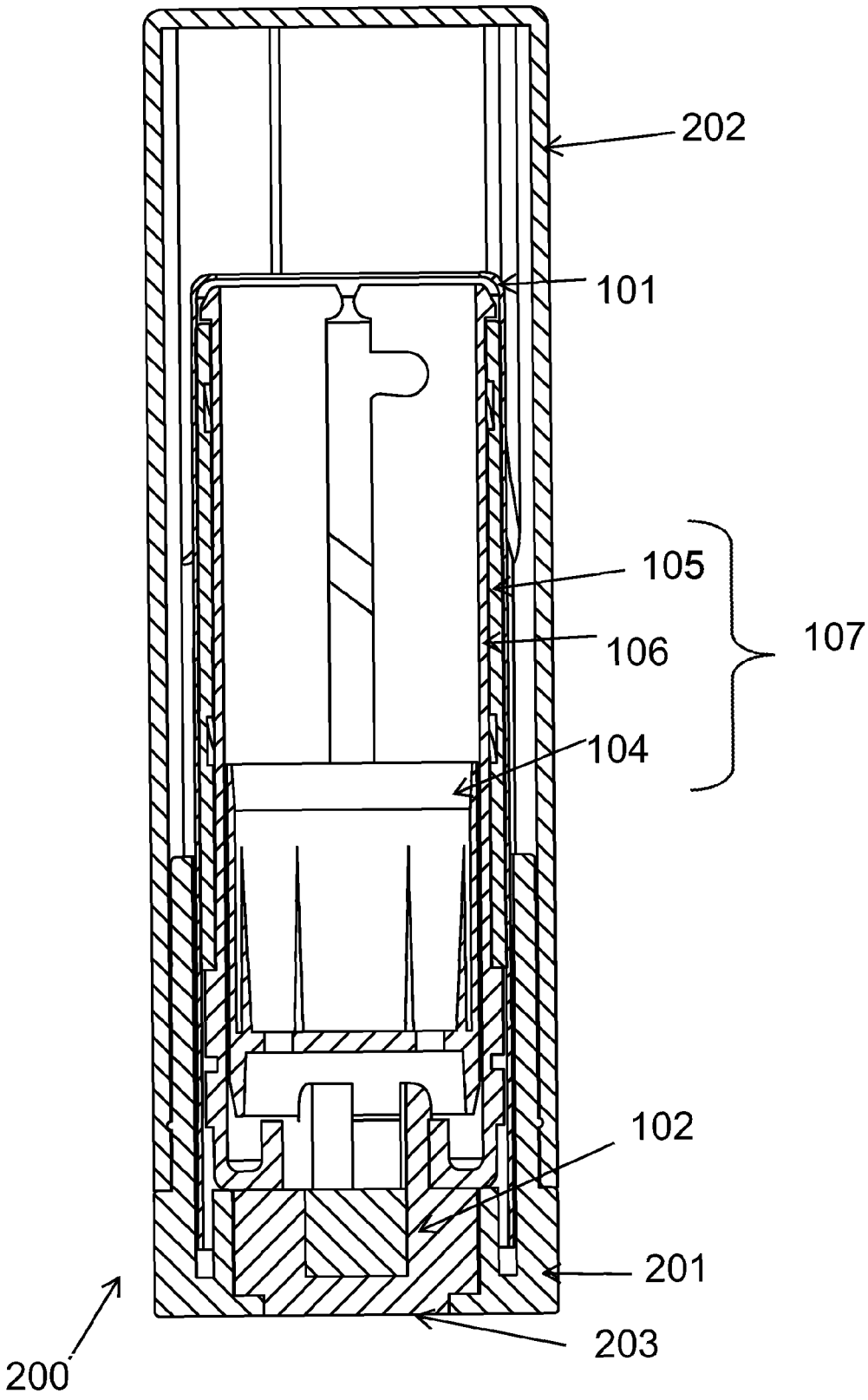
FIG. 11 is a cross-sectional view of the refillable container of FIG. 7.

FIGS. 7 through to 11 represent a refillable case 200 comprising a base 201 and a cover 202. The base 201 of the refillable case 200 comprises a faceted cavity 203 onto which is mounted the refill container 100. The receptacle 102 in the refill container 100 is configured to have a shape/design corresponding to the cavity 203 of the base 201 such that it securely fits into the base 201. The faceted cavity is one of the ways of locking the refill container with the base, however, any other suitable arrangement may be used for locking the base 201 and the refill container 100. The refill container 100 is mounted on the base 201 such that the top end of the container is facing the cover 202 while the bottom end faces the base 201. The receptacle 102 of the refill container 100 holds either a product or a tool which is configured to be accessible through the base 201 of the refillable case 200. The refill container 100 is configured to be detachably mounted on the base 201. The propelling mechanism assembly 107 of the refill container 100 comprises of the cup 104, the drive 105 and the helix 106 and it is configured to be operable once it is mounted onto the base 201.

The base 201 and the cover 202 may be formed of any polymeric material such as acrylonitrile butyrene styrene or any other suitable material.

Figure 12:
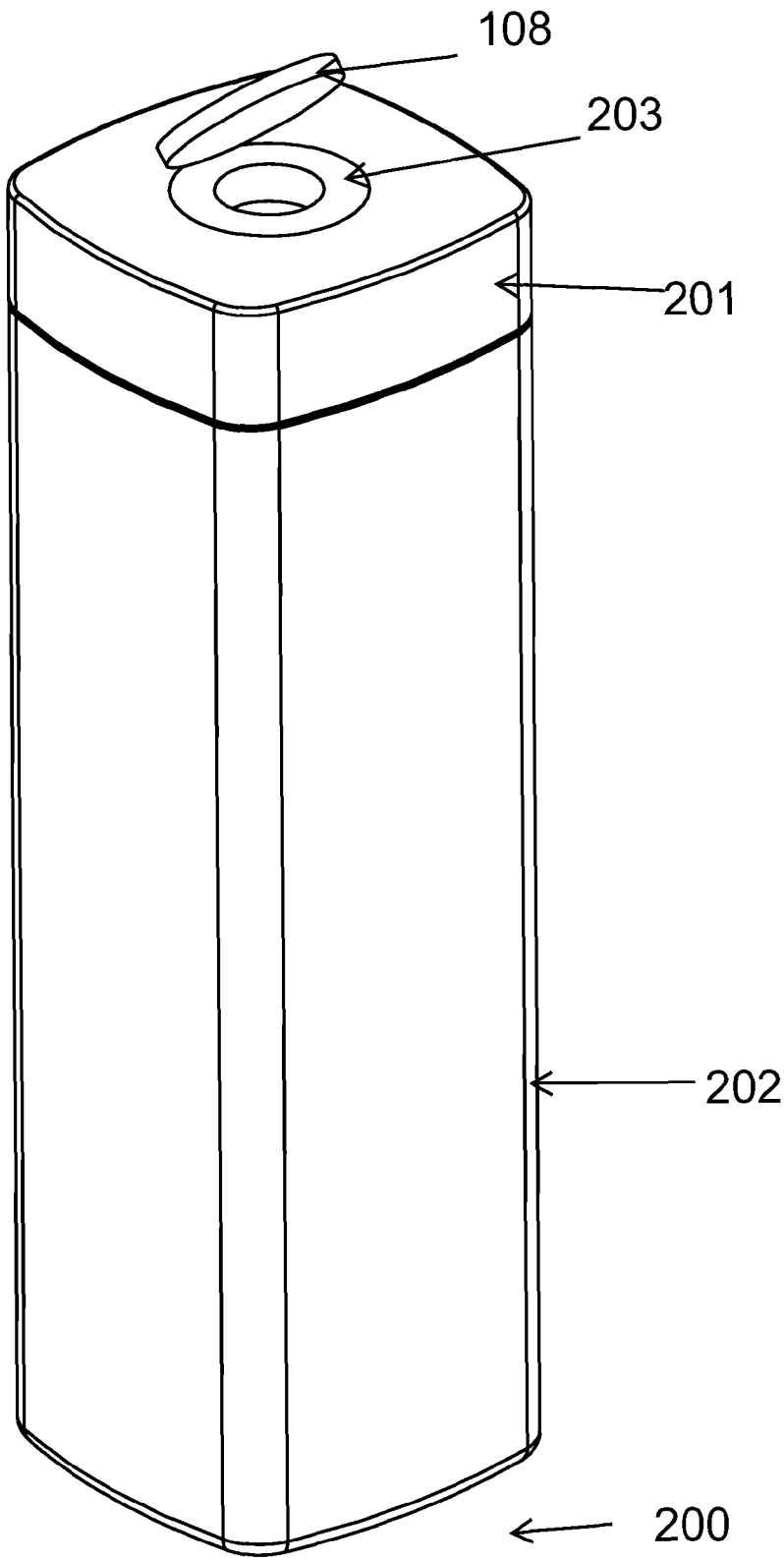
FIG. 12 is an isometric view of the refillable container according to another embodiment of the invention.

FIG. 12 represents the refillable case 200 according to another embodiment of the invention. As shown, the second receptacle 102 has a closure member 104 which is configured to be opened while the refill container 100 is mounted onto the base 201 thereby allowing the second product or tool contained in the second receptacle 102 to be accessed.

Although the above description and drawings show the refill container, and in particular the receptacles thereof, being cylindrical, the shapes and profile cross section thereof are not limited to the same.

While the foregoing is directed to embodiments of the present invention, other and further embodiments of the invention may be devised without departing from the basic scope thereof, and the scope thereof is determined by the claims that follow. Accordingly, the appended claims should be construed to encompass not only those forms and embodiments of the invention specifically described above, but to such other forms and embodiments as may be devised by those skilled in the art without departing from its true spirit and scope.

What is claimed is:

1. A refill container comprising: at least two receptacles for storing products of same color, each receptacle having a top end, a bottom end and at least one sidewall, wherein the receptacles are fixedly attached to each other by an attachment means, and wherein the at least two receptacles are configured to be securely placed in a refillable case wherein said case comprises a base and a cover, and wherein at least one of the receptacles is configured to be securely received in the base of the refillable case such that the product stored in said receptacle is not accessible after assembling the said receptacle and the base, and wherein the base of the refillable case and the at least one receptacle of the refill container to be received by said base have a locking arrangement to securely keep the refill container in place, and wherein the base of the refillable case and the receptacle of the refill container to be received by said base will either be transparent or have a transparent window to show the color of the product stored within the receptacle of the refill container to be received by said base.

2. The refill container of claim 1 wherein at least one of the receptacles house a tool.

3. The refill container of claim 2 wherein a receptacle of the refill container comprises a propelling mechanism assembly or a part of a propelling mechanism assembly for driving the product wherein said propelling mechanism assembly is actuated when the refill container is mounted on the base of the refillable case.

4. The refill container of claim 2 wherein a propelling mechanism assembly or a part of the propelling mechanism assembly is present in the base of the refillable case for driving the product housed in the receptacle wherein the propelling mechanism assembly is actuated when the refill container is mounted on the base of the refillable case.

5. The refill container of claim 1 wherein the refill container comprises a first and a second receptacle wherein bottom end of second receptacle abuts one end of the first receptacle and said receptacles are securely connected by an snap fit attachment means.

6. The refill container of claim 5 wherein the first receptacle holds a first product wherein the product is a stick consumer product and the second receptacle holds a second product, wherein the color of the second product and the first product is same.

7. The refill container of claim 6 wherein the first receptacle of the refill container comprises a propelling mechanism assembly or a part of a propelling mechanism assembly for driving the stick product wherein said propelling mechanism assembly is actuated when the refill container is mounted on the base of the refillable case.

8. The refill container of claim 7 wherein the propelling mechanism assembly comprises of a mechanism such as a general lipstick mechanism, a threaded screw mechanism or a sliding mechanism and wherein the base of the refillable case is the actuator of the propelling mechanism assembly of the stick product.

9. The refill container of claim 6 wherein a propelling mechanism assembly or a part of the propelling mechanism assembly is present in the base of the refillable case for driving the stick product housed in the receptacle wherein the propelling mechanism assembly is actuated when the refill container is mounted on the base of the refillable case.

10. The refill container of claim 6 wherein the base of the refillable case comprises a faceted cavity and wherein the second receptacle in the refill container is configured to have a shape/design corresponding to the cavity of the base of the refillable case such that it securely fits into the cavity.

11. The refill container of claim 1 wherein one of the receptacles contain a consumer product such as a cosmetic or a care product such as lipstick, eye shadow, lip balm, concealer, a muscle relaxant, foundation, concealer, bronzer, lip color, a balm, a solid perfume, exfoliator, shimmer, highlighter, concealer, primer, base balm or wipes.

* * * * *